United States Patent [19]

Blake

[11] 4,089,270

[45] May 16, 1978

[54] PERSONAL TRANSPORATION SYSTEM

[75] Inventor: A. Webster Blake, Scottsdale, Ariz.

[73] Assignee: Dahlberg Industries, Scottsdale, Ariz.

[21] Appl. No.: 724,388

[22] Filed: Sep. 17, 1976

[51] Int. Cl.[2] ..... E01B 25/12

[52] U.S. Cl. ..... 104/130; 104/102; 104/119

[58] Field of Search ..... 104/96, 102, 103, 118, 104/119, 120, 121, 130, 139, 140, 141, 146, 149, 161; 105/141, 144, 145

[56] References Cited

U.S. PATENT DOCUMENTS

| | | | |
|---|---|---|---|
| 3,073,259 | 1/1963 | Peterson | 104/130 |
| 3,263,073 | 7/1966 | Westerweel | 104/88 |
| 3,451,350 | 6/1969 | Bryson | 104/88 |
| 3,769,915 | 11/1973 | Swartz | 104/130 |
| 3,793,959 | 2/1974 | Levenberger | 104/119 |
| 3,838,648 | 10/1974 | Dahlberg et al. | 104/139 |
| 3,841,226 | 10/1974 | Maison | 104/130 |
| 3,859,925 | 1/1975 | Hartz | 104/139 |

*Primary Examiner*—Drayton E. Hoffman
*Assistant Examiner*—Carl Rowold
*Attorney, Agent, or Firm*—Cahill, Sutton & Thomas

[57] ABSTRACT

A personal transportation system including a guideway of channel members submerged beneath the ground with an opening along the ground line, the guideway including an intersection, a rail running along the base of the channel members for supporting wheeled, passenger carrying vehicle thereon, and a steering system for selectively steering the vehicle through the intersection and into one of at least two guideway sections leading from the intersection. The steering system includes a probe extending forward of the vehicle and a guide member in the form of a vane associated with the guideway such that the probe contacts the guide member causing the guide member to move to a position wherein the vehicle is selectively guided through the intersection and into one of the guideway sections leading from the intersection, such guidance being accomplished by orienting the probe relative to the guide member such that the latter is moved to a position which provides positive guidance of the vehicle into the desired exiting guideway section. The vehicle is provided with controls manually or remotely operable to command operation of the vehicle. The opening of the guideway is provided with a cover in the form of a pair of flaps which meet in a puckered relationship at the center line of the channel opening. The cover is constructed to prevent debris from falling into the channel in normal use. The flaps are pushed apart by the vehicle as it travels and upon passing the flaps return to their puckered relationship.

9 Claims, 11 Drawing Figures

PERSONAL TRANSPORATION SYSTEM

This invention relates to a personal transportation system, and in particular to a system in which a vehicle travels on a rail in a dedicated guideway.

Various monorail-type transportation systems have been designed to carry people along a guided path from one point to another. The desirability of monorail systems to move people has long been recognized. Many such systems however, have been far too costly either in initial construction or in maintenance or both to enjoy popular use. Economy has been sought by reducing the personalized features of the system, but the sacrifice in convenience has generally been so great that the system is shunned by potential users. Another disadvantage to many people mover systems is their environmental unattractiveness, especially with systems having aboveground rail lines. Still further, many of the systems require trained operators to operate the system in a safe manner.

Monorail people mover systems may be used to provide general mass transportation over relatively long distances or may be used to provide transportation within a relatively confined area such as shopping centers and recreational facilities. The system of the present invention may serve either function but is primarily adapted for the latter use. Another such system is described in commonly assigned U.S. Pat. No. 3,838,648. A particularly appropriate but by no means exclusive use for the system of this invention is in transporting golfers and their equipment along a golf course.

The system of this invention, as applied to golf courses, will eliminate soil compaction created by the tires of conventional golf carts; will provide safer transportation than conventional golf carts; and in many cases will increase the speed of play thereby allowing, on any day, a greater number of players to play the golf course equipped with the system of this invention.

In accordance with the above discussion, it is a primary object of this invention to provide a personal transportation system which is convenient and safe for the user, relatively low cost in initial construction and maintenance, individually operable, does not require trained operators, and is capable of a variety of maneuvers.

These and other objects of the present invention are accomplished by a personal transportation system comprising in combination a guideway of upright channel cross-section substantially set into the ground and having upright sidewalls and a vehicle supporting main rail at the bottom of said channel, said guideway including an intersection segment, a mainline segment having a first mainline sub-segment entering said intersection segment and a second mainline sub-segment exiting said intersection segment, and a turn segment exiting from said intersection segment in a direction at an angle different from the direction of said second mainline sub-segment, said vehicle comprising a frame having an upright support and a body or cab mounted on said frame, support wheel means mounted in said upright support configured to ride on said rail, lateral support means mounted on opposing sides of said frame for contacting said sidewalls to provide lateral support for said vehicle in said guideway, steering means for selectively directing said vehicle from said first mainline sub-segment through said intersection segment and into one of said second mainline sub-segment and said turn segment, said steering means comprising probe means extending forward of said vehicle and guide means associated with said intersection segment, said guide means being adapted and positioned to cooperatively engage said probe means whereby said vehicle passes out of said intersection segment in a predetermined direction, and motor means mounted on said frame for driving said wheel means.

The guideway is preferably provided with a bifurcated flexible cover which parts to allow passage of the vehicle and thereafter returns to its channel covering configuration. The vehicle is motorized, and preferably is powered by a series of storage batteries. The vehicle may also be powered by conventional means such as gasoline engines as well as by alternating current utilizing electrical lines and brushes within the guideway, as described in commonly assigned U.S. Pat. No. 3,838,648, which patent is incorporated herein by reference. A set of three wheels is preferably provided, one for each of the upright support sections, with only the central wheel being driven. The forward and rear wheels are supported by vertical members independently biased to urge the wheels into positive engagement with the rail thereby maintaining these wheels in engagement with the rail even when the vertically stationary central wheel is at a different elevation. A control system for maneuvering and operating the vehicle is provided to permit manual operation by a passenger. The control system, or at least certain elements of the system, may also be remotely controlled.

The steering system by which the vehicle is guided through an intersection and into one of at least two alternative guideway sections is particularly noteworthy. A probe is attached to the front and preferably also the rear of the vehicle to permit turning of the vehicle during forward and backward travel. The probe enters the turning zone in advance of the vehicle, and makes contact with the guide means which extends into the turning zone. The relative orientation of the probe and guide means at the point of contact determines the direction the vehicle will take in exiting from the intersection. Preferably, the guide means is held in a neutral position prior to making contact with the probe, and the probe orientation is set as needed. The advancing properly oriented probe moves the guide means, preferably by a flexing of the guide means, to a position which will guide the vehicle into the desired guideway section exiting from the intersection. The vehicle includes a forward, mid, and rear section each having associated wheels. The forward and rear sections are hingably mounted to the mid-section. As the probe makes positive contact with the guide means, and the guide means moves into the appropriate guiding orientation, the forward section follows the path defined by the guide means to thereby control direction of the vehicle. If a change of direction is dictated by the guide means, the front section pivots about its hinge points causing its associated wheel to turn likewise to accomplish the maneuver.

DESCRIPTION OF THE DRAWINGS

Referring to FIG. 1, a vehicle 20 is shown traveling on an underground guideway 24 located on a golf course. Guideway 24 has a main line 28 and a leftward spur 32. Vehicle 20 includes a body 23 equipped with a pair of seats 36 between which is located the control panel 40 for manual control of the vehicle from either passenger location. Vehicle 20 has a body shell 44 preferably of epoxy and fiber-glass construction. Rear section 48 of shell 44 houses the power and control units for the vehicle. Rear section 48 is hinged at points 52 (only left side hinge shown) to the frame of the vehicle for raising to provide access to the power and control units.

Referring to FIGS. 2 and 3, body shell 44 is mounted on horizontal mounting plate 56. Battery 60 is positioned on plate 56. The battery system is electrically connected by cables 64 to a power control box 68 which houses the power relays and electrical circuits for energizing the relays. Electrically connected to control box 68 is a logic box 72 housing decoding and logic circuits. The decoding and logic circuits transmit and receive digital signals from sources to be explained hereinafter, and convert such signals to analog signals which are transmitted to the control box 68. A radio receiver unit 76, the function of which will be explained hereinafter, is connected to logic box 72. Control box 68 is electrically connected to a conventional DC motor 80 (36 volt, 2–4 h.p.) (see FIG. 3). The motor 80 is coupled to a transmission system 84 including input pulley 88 and belt 92. The transmission output is coupled to sprocket 96 carrying a main drive chain 100 which drives sprocket 104 mounted on shaft 108. Secondary drive sprockets (two) 112 are mounted on shaft 108. Secondary drive sprockets 112 (see FIG. 3) carry secondary drive chains (two) 116 which in turn are carried on wheel sprockets (two) 120 mounted on the center drive wheel axle 124 of center drive wheel 128.

Figure 4:
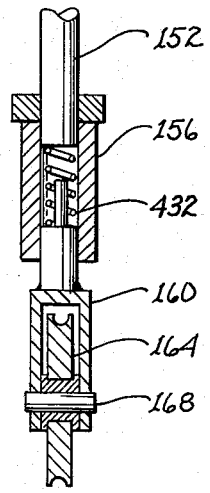
FIG. 4 is a cross-sectional view taken along line 4—4 of FIG. 2.

Attached by hinge pin 132 to the underside of mounting plate 56 is rear swing plate 136. Rearward of swing plate 136 is a perimeter beam 140 for providing stability to the chassis. Mounted on swing plate 136 by bracket 144 is a roller 148. Rigidly mounted to the underside of swing plate 136 is vertical support rod 152 to which is mounted rearward housing 156. Entering housing 156 from below is yoke 160 mounted on rear wheel 164 by axle 168. The details of housing 156 are shown in FIG. 4. A rear hinge plate 172 is fixedly mounted to housing 156. To the rear of housing 156 is preferably attached a rear probe system which is the same as the front probe system shown in FIG. 5. Mounted on rear hinge plate 172 by means of bracket 180 is a roller 184. A second roller 184 is provided on the opposing side of hinge plate 172 (see FIG. 5). Rear hinge plate 172 is attached to rear main plate 188 by hinge 192. Rear main plate 188 is fixedly attached to lateral plate 196. A forward main plate 200 is also fixedly attached to lateral plate 196. Forward main plate 200 in turn is attached by hinge 204 to forward hinge plate 208. Attached by hinge 212 to the underside of mounting plate 56 is a forward swing plate 216. Forward of swing plate 216 is perimeter beam 140. Mounted on swing plate 216 by bracket 220 are rollers 224. Rigidly mounted to the underside of swing plate 216 is a vertical support rod 228. Rigidly mounted to support rod 228 is a forward housing 232. Entering housing 232 from below is yoke 236 mounted on front wheel 240 by axle 244. Forward of housing 232 is a front probe 248 shown in detail in FIG. 5. Mounted on the side of forward hinge plate 208 are rollers 252.

Figure 1:
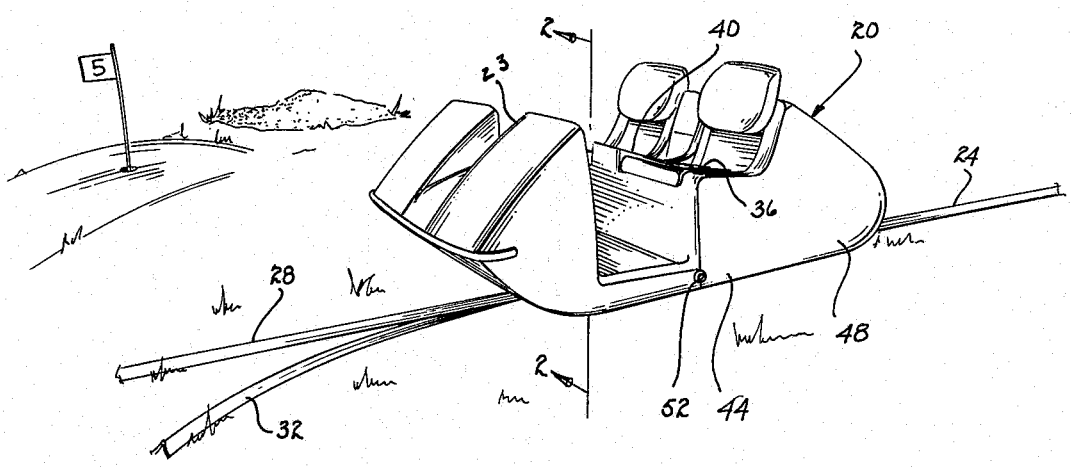
FIG. 1 is a pictorial view of the invention in use.
Figure 2:
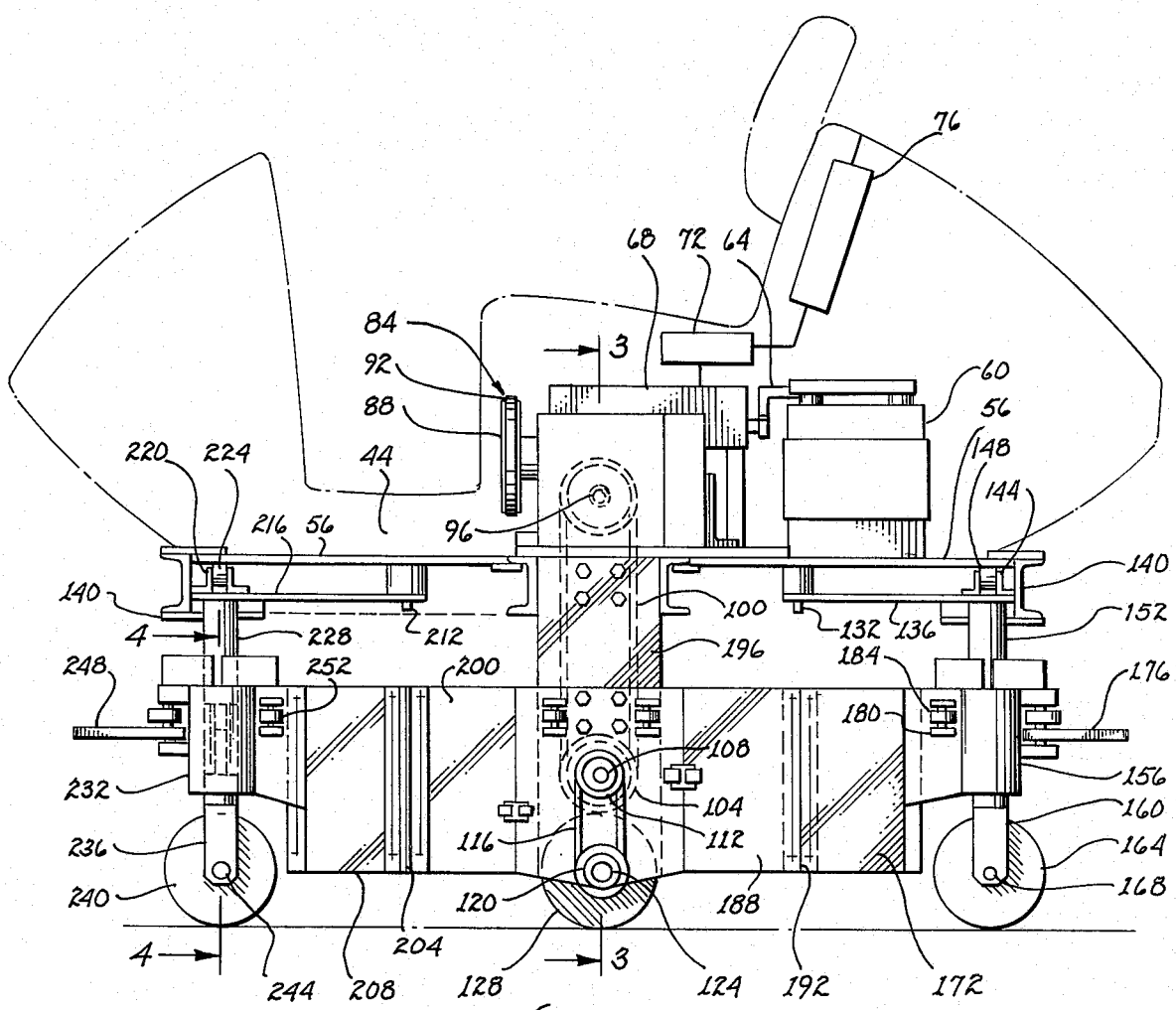
FIG. 2 is a cross-sectional view in elevation taken along line 2—2 of FIG. 1.
Figure 3:
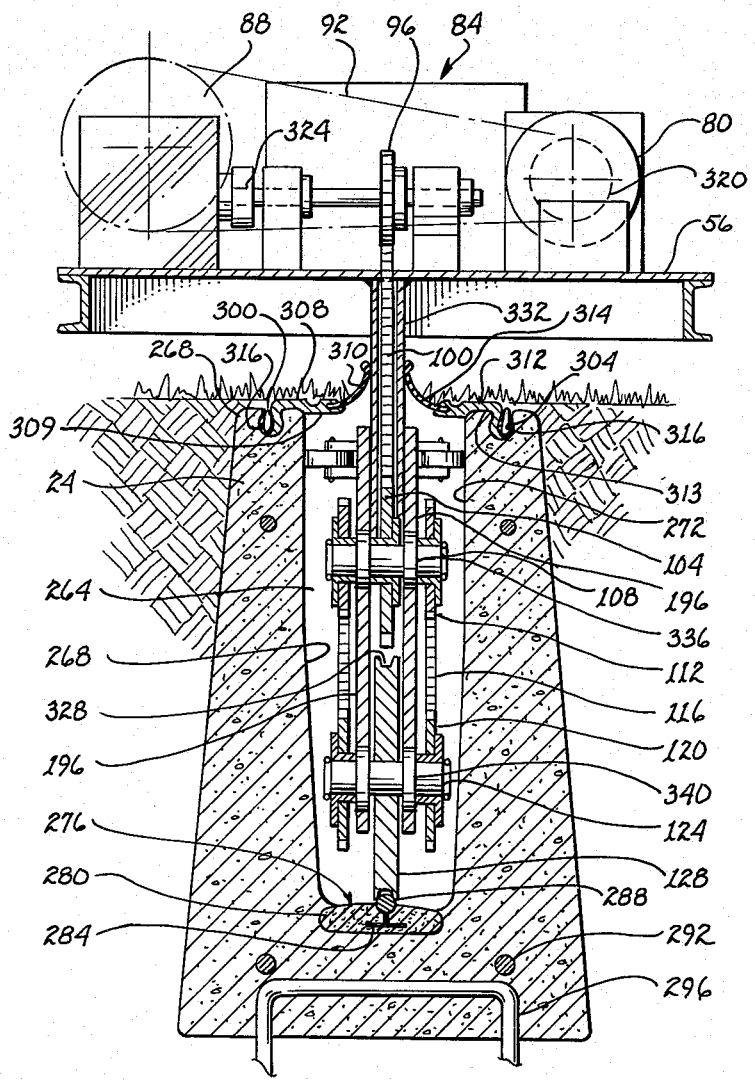
FIG. 3 is a cross-sectional view taken along line 3—3 of FIG. 2.

As seen in FIG. 3, the dedicated guideway 24 is substantially below the earth line. Guideway 24 has a longitudinally extending channel 264 defined by symmetrical sides 268 and 272. The inner walls of sides 268 and 272 extend vertically downward for a distance and then slope inwardly slightly to the edge of grouting section 276. The side walls of grouting section 276 bulge outwardly, the purpose of which is to securably contain the grouting material 280. Embedded in grouting material 280 is rail holder 284. Rail holder 284 is spaced at intervals along grouting section 276 to securably retain rail 288 in desired alignment. Reinforcement of guideway 24 is provided by axially aligned bars 292 and transverse bars 296. Extending longitudinally along the top of sides 268 and 272 are grooves 300 and 304. The end tabs of coping members 308 and 312 are held in place by wedges 316. The coping members 308 and 312 each include a relatively rigid cover section 309 and 313, respectively, including the tabs, and a flexible flap section 310 and 314, respectively. Coping members 308 and 312 cover the opening of guideway 24. As the vehicle passes, the upwardly puckered flaps 310 and 314 are parted as shown in FIG. 3 to accomodate the vertical support elements of the vehicle. After the vehicle has passed, the flaps return to the closed position.

Mounted to plate 56 are elements of the power/transmission system including motor 80 equipped with a pulley 320 which carries drive-belt 92. Output shaft 324 is keyed to main drive sprocket 96 on which is mounted main drive chain 100. Main drive chain 100 drives sprocket 104 keyed to shaft 108 to opposing ends of which are keyed secondary drive sprockets 112. To the latter are mounted secondary drive chains 116, which in turn are carried by wheel sprockets 120 keyed to center wheel axle 124 of center wheel 128. Center wheel 128 has a circumferential groove 328 having a contour sufficient to provide the necessary friction between wheel 128 and rail 288 without excessive wear of the contacting surfaces. Extending from the underside of mounting plate 56 is main support rod 332. To opposing sides of rod 332 are connected lateral plates 196 equipped with a first set of bearings 336 through which pass shaft 108 and a second set of bearings 340 through which pass center wheel axle 124.

FIG. 4 illustrates the support assembly for forward and rear wheels 240 and 164, respectively. Since the forward and rear wheels are essentially the same, only the rear mounting will be described. The vertical support rod 152 extends into housing 156. Housing 156 is designed to restrain lateral and transverse movement of rod 152, while allowing vertical movement as described hereinafter. A stiff spring 432 is mounted within the housing 156, one end of which presses against the vertical support rod 152 and the other end of which transmits its force to the yoke wheel assembly including yoke 160, axle 168 and wheel 164. Spring 432 exerts a force of several hundred pounds against the rail 288 when in the neutral position (all three wheels level). Springs are preferred in at least one of the forward and rear wheel assemblies to guarantee that sufficient force is exerted on the drive wheel when the wheels are not all level such as will be encountered from crowns and sags in the guideway rail. The rear spring should be slightly stiffer than the forward springs if the vehicle is expected to carry heavy loads at the rear, in order to accomodate the additional load.

Figure 5:
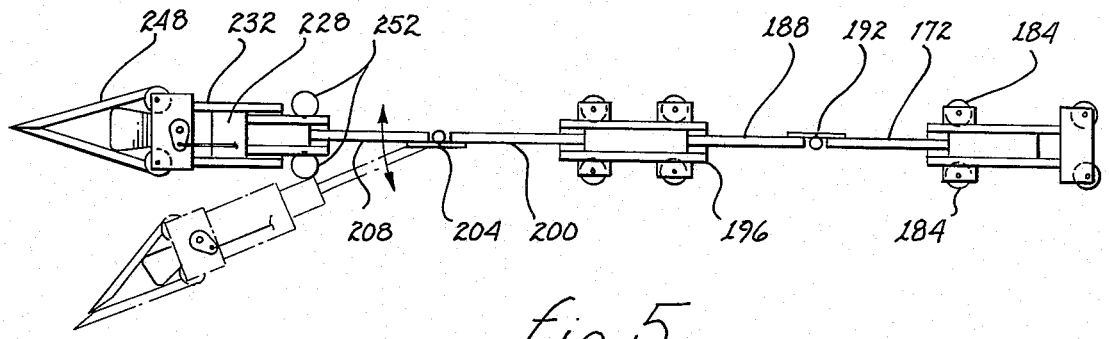
FIG. 5 is a plan view of the support and probe components of the invention.

FIG. 5 illustrates the support system and forward probe of the vehicle. If probe 248 is moved to the left, the forward hinge plate 208 also moves to the left as it is hinged at hinge point 204. The forward main plate 200, rear main plate 188 and lateral plates 196 are not hinged. If probe 248 is held straight in respect to the other sections, all three sections will assume a straight line. The forward section, including probe 248, housing 232, wheel 240, forward hinge plate 208, forward swing plate 216, rollers 224, hinges 204 and hinge pin 212, is duplicated in the rear section. The action is thus identical in either forward or reverse directions of the vehicle, so that switching or turning can be accomplished whether the vehicle is traveling forward or backward.

Figure 6A:
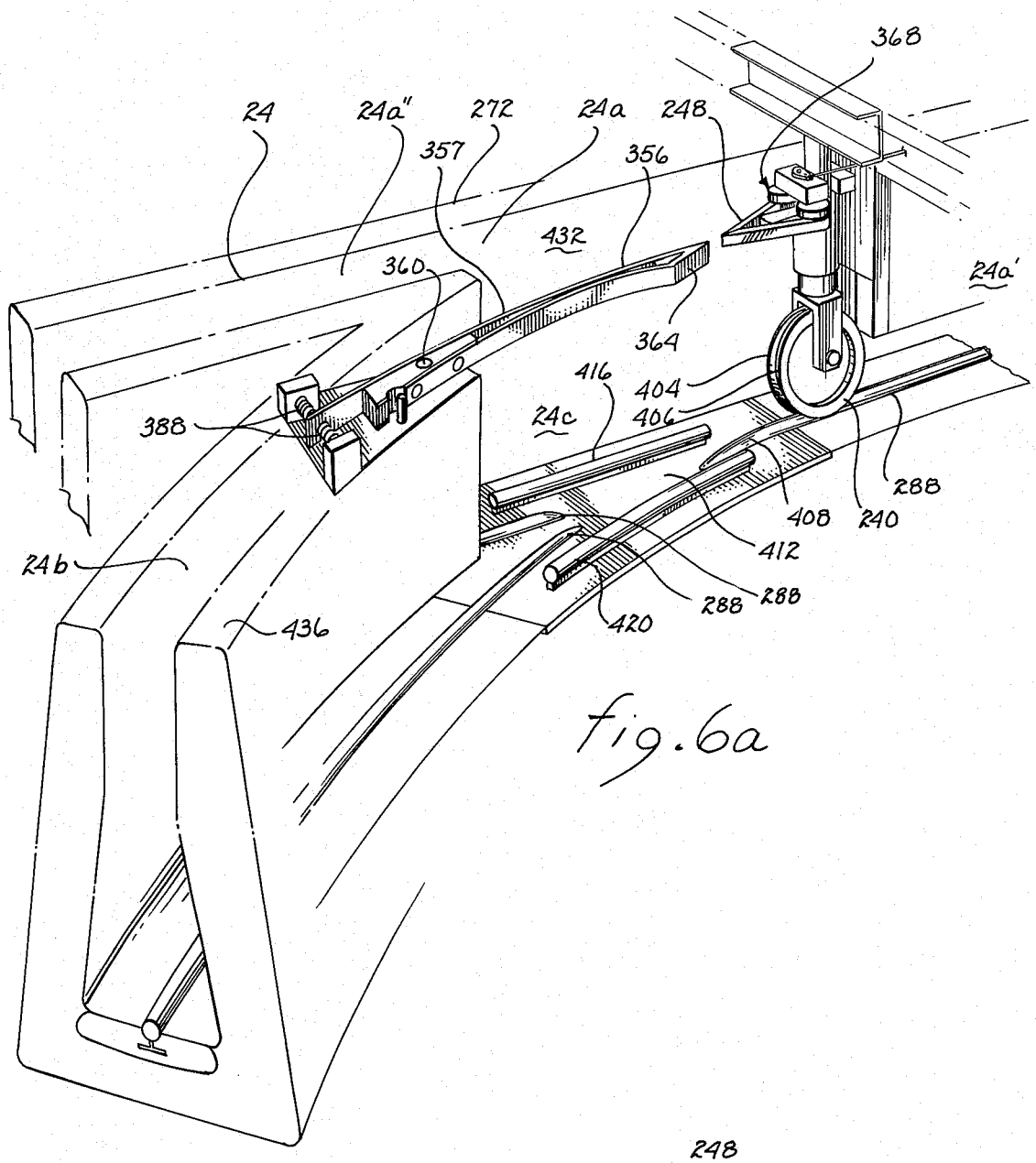
FIG. 6*a* is a perspective view of the guideway and steering system of the invention.
Figure 6B:
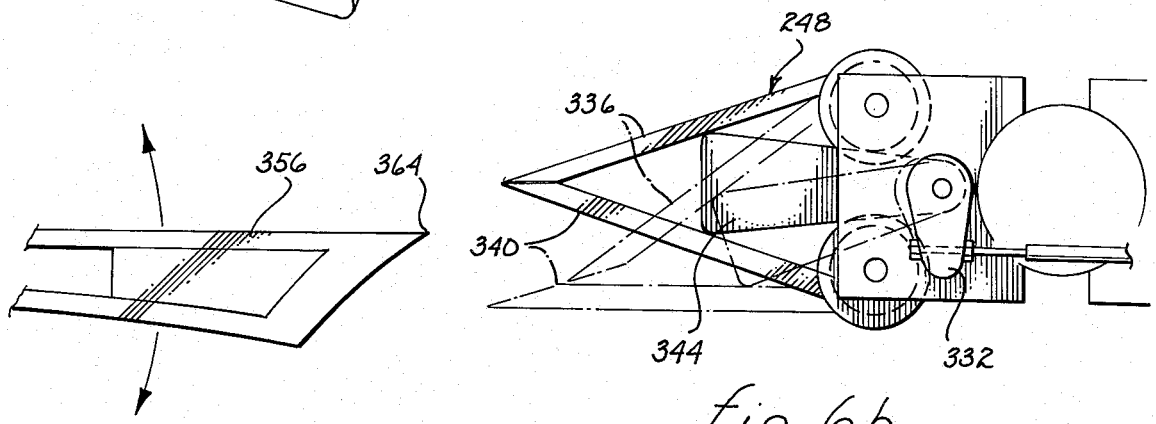
FIG. 6*b* is a plan view showing details of the steering system of the invention.

Referring to FIG. 6*a*, a switch section of guideway 24 is shown including a mainline segment 24*a* and a left spur segment 24*b*. Mainline segment 24*a* includes a sub-segment 24*a'* and a sub-segment 24*a''* in alignment therewith. Between the sub-segments and spur segment 24*b* is an intersection segment 24*c*. This figure shows the forward end of the vehicle 20 approaching the switch section. It can be seen that probe 248 extends foremost. The relative positioning of probe 248 and moveable switching vane 356 of guide member 357 determines which direction the vehicle 20 will assume when the vehicle exits from the intersection segment 24*c*. This is best illustrated by FIG. 6*b* which shows probe 248 in respect to switching vane end 364 of switching vane 356. Probe 248 is shown in solid line for passage of the vehicle 20 from sub-segment 24*a'* through intersection segment 24*c* into segment 24*a''* and in broken line for passage of vehicle 20 from sub-segment 24*a'* through intersection segment 24*c* into spur segment 24*b*. These positions of probe 248 are set by (a) no pull on directional arm 332 (neutral), or (b) pull on directional arm 332 which forces directional plate 344 to move down in the drawing (to the left) causing directional probe 248 to pivot to the left. It is to be understood that the steering system is equally capable of right-hand turns. As the vehicle 20 advances into intersection segment 24*c*, probe 248 strikes the switching vane end 364. If probe 248 is in the neutral (solid line) position, the switching vane end 364 strikes the left wall 340 of probe 248 forcing the switching vane 356 to the left by a camming action. If probe 248 is in the left-turn position, the switching vane end 364 strikes the right wall 336 of probe 248 forcing the switching vane 356 to the right, again by a camming action.

Figure 6C:
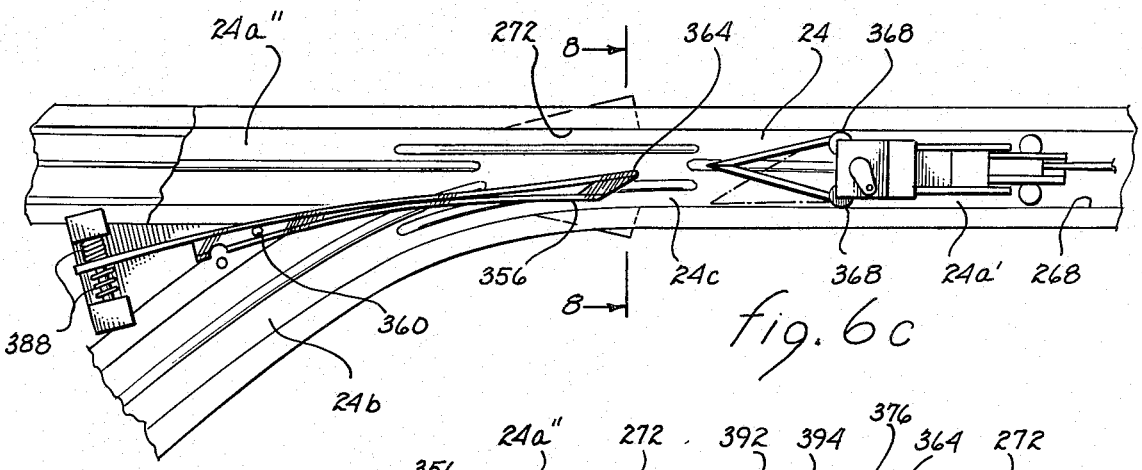
FIG. 6*c* is a plan view showing details of operation of the steering system of the invention.
Figure 7:
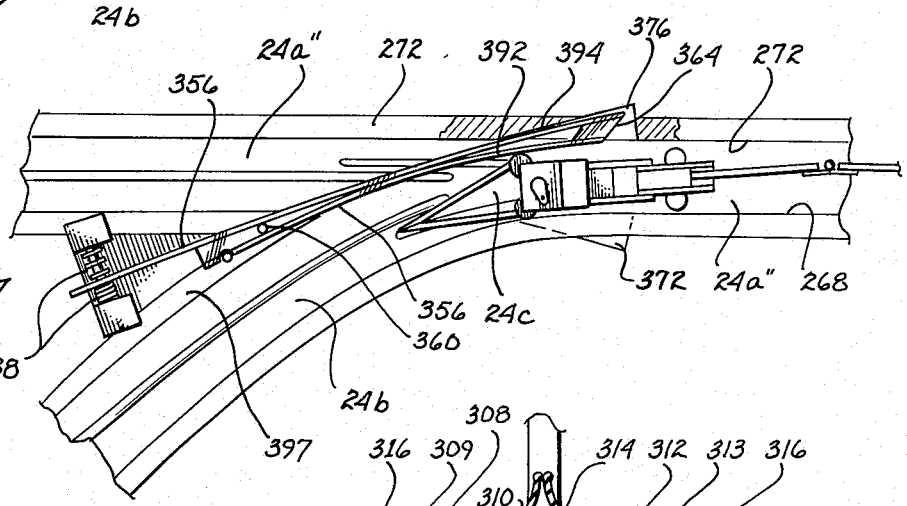
FIG. 7 is a plan view of the steering system in the course of a left turn.

FIG. 6*c* shows the relationship of the switching vane 356 in respect to the guideway 24. The switching vane end 364 assumes a neutral position (solid line) when no forces are applied to it due to the balanced springs set 388. When forces are applied in either direction to the switching vane 356 it will swing about the hingepin 360 against the spring pressure of the balanced spring set 388. It can be forced to flex into engagement with either wall 268 or 272 of the guideway 24 as shown in broken line. FIG. 7 shows the vane against wall 272 with the end 364 extending into cut out section 376 of that wall. In this position the forward portion of arm 392 of the switching vane 356 provides a smooth continuation of the guide way wall 272 and the rearward portion of arm 392 is a smooth continuation of the curved wall 397 of the left turn spur segment 24*b*. In this position, entrance to sub-segment 24*a''* is blocked and vane 356 guides the vehicle into spur segment 24*b*. If the switching vane 356 is pushed against the left wall 268 into the cut out section 372, the forward portion of arm 394 of the switching vane becomes a continuation of 268 of the guideway and the rearward portion of arm 394 becomes a continuation of wall 268 of sub-segment 24*a''* such that the entrance to spur segment 24*b* is blocked and vane 356 guides the vehicle into sub-segment 24*a''*.

Reference to FIG. 6*a* illustrates how the wheels of the vehicle change from one track to another within intersection segment 24*c*. For straight line operation, the switching vane 356 is pressed against the left wall 268 (relative to line of travel of vehicle 20). Probe 248 forces the left side of roller set 368 against arm 394 so that front wheel 240 is not allowed to turn, but is held firmly in a straight forward direction. When wheel 240 rolls off the tapered end of rail 288, the outside edges of wheel 240 roll on the flat switch bottom plate 412 until the wheel reaches the opposite tapered end of rail 288 in sub-segment 24*a''*. A short retaining wall section 416 also assists the wheel in maintaining a straight course while not restrained by the guidance of rail 288. Roller set 368 will continue to roll with its right side against wall 272 as it progresses out of intersection 24*c* into guide way segment 24*a''*. This is a smooth operation with no abrupt changes in level or direction.

For left turn operation, switching vane 356 is pressed against right wall 272. Probe assembly 248 forces roller set 368 against curved wall section 436 of spur segment 24*b* so that front wheel 240 follows the direction of that wall, i.e. the wheel is turned to the left. When front wheel 240 rolls off the end of rail 288, wheel flanges 404 and 406 roll on the flat switch plate 412 until the wheel reaches the opposite tapered end of left turn rail 288. A short retaining wall section 420 helps to maintain the proper course for wheel 240 while guidance is unassisted by rail 288 within the wheel groove 328.

Figure 8:
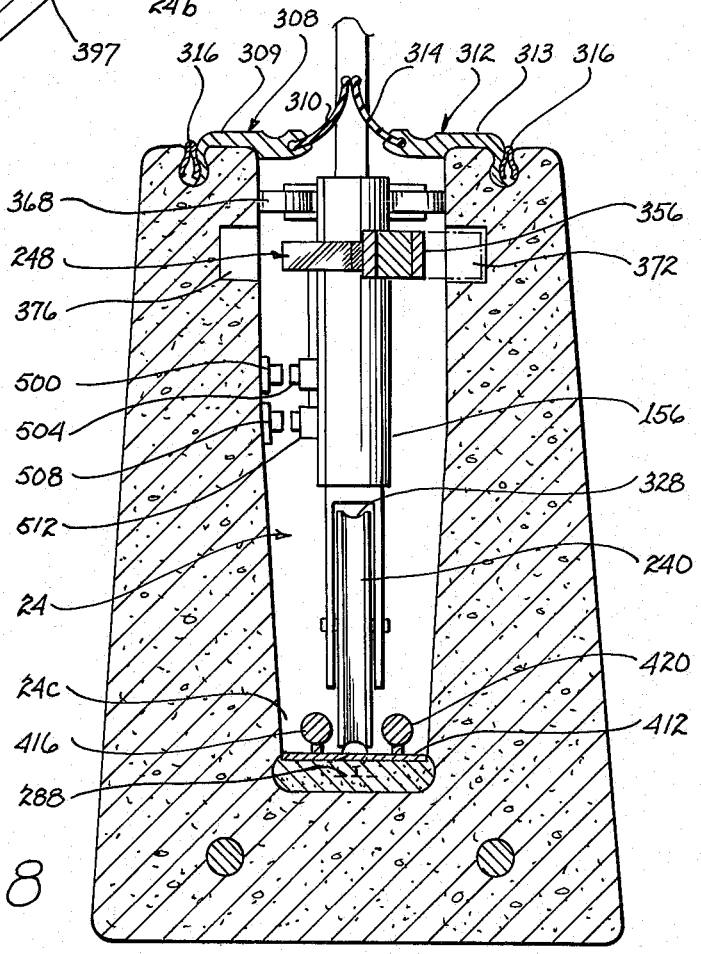
FIG. 8 is a cross-sectional view taken along line 8—8 of FIG. 6*c*.

FIG. 8 shows the front view of front wheel 240 in guideway 24 as it starts to enter intersection segment 24*c*. Also shown in FIG. 8 are signal emitters 500 and 508 which emit signals received by aligned sensors 504 and 512, respectively, associated with the vehicle. The signals contain information which is translated into intelligible information such as the distance of the vehicle from a specified location. Emitters 500 and 508 are preferably magnets and the signal is in the form of magnetic lines of force. Sensors 504 and 512 are responsive to such magnetic lines of force.

Figure 9:
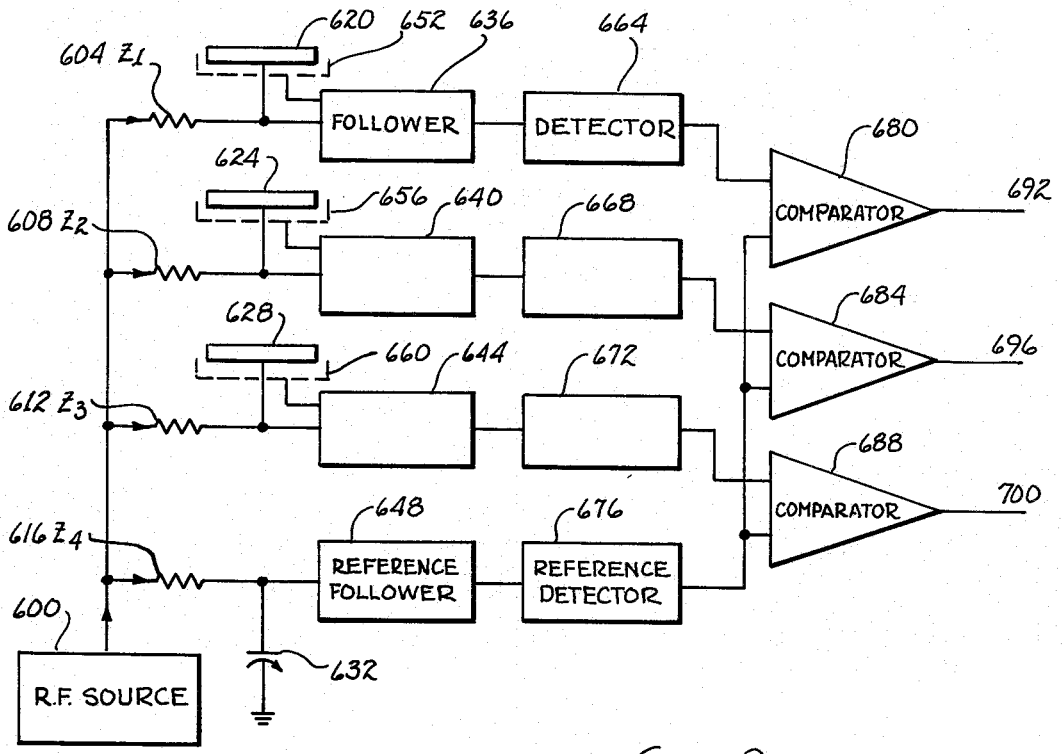
FIG. 9 is a block diagram of a touch button control system for operating the invention.

FIG. 9 is a block diagram of the touch control panel 40. The various touch controls are operated by the capacity to ground from the operator's finger. There are three command buttons shown; stop button 620, go button 624, and turn button 628. A finger pressing against a button introduces capacity across the button to ground which shunts a signal fed from radio frequency source 600 thereby reducing the signal level at the associated detector 664, 668 and 672, as the case may be.

The detector output is a D.C. signal which is inversely proportional to the shunt capacity from the finger at the push button. The associated comparator 680, 684 or 688 compares this output voltage to a preset reference voltage. If the detector output is less than the reference voltage a signal is generated; if it is greater than the reference voltage no signal is generated. Hence the output is either "on" or "off" depending on the capacity to ground at the button face. The radio frequency source 600 can be from 50 to 100 kilohertz. This is fed to series impedances 604, 608, 612 and 616, one for each push button 620, 624 and 628 and reference 632. The voltage (radio frequency signal) at push buttons 620, 624, 628 and reference 632 is a function of the ratio of impedances. This signal level is determined by the small added capacity of the finger to ground or simulated by variable reference capacitance from reference 632 which does the same thing but is preset to produce a definite signal level. A separate follower 636, 640, 644 and 648 follows the signal level at each push button and reference 632 without adding appreciable capacity or other effects. The associated follower also feeds a signal back to guard the push button from ground effects. The guards around the push button are shown as 652, 656 and 660. The output impedance from the followers is low enough to drive a separate detector 664, 668, 672 and 676 for each push button. The output from each detector is fed into an associated comparator 680, 684 or 688. These signals are compared in amplitude to the reference signal from reference detector 676. The output signal 692, 696 and 700 from each comparator will be an "on" or "off" signal at logic level which can control the vehicle to go, stop, turn or change speed.

Figure 10:
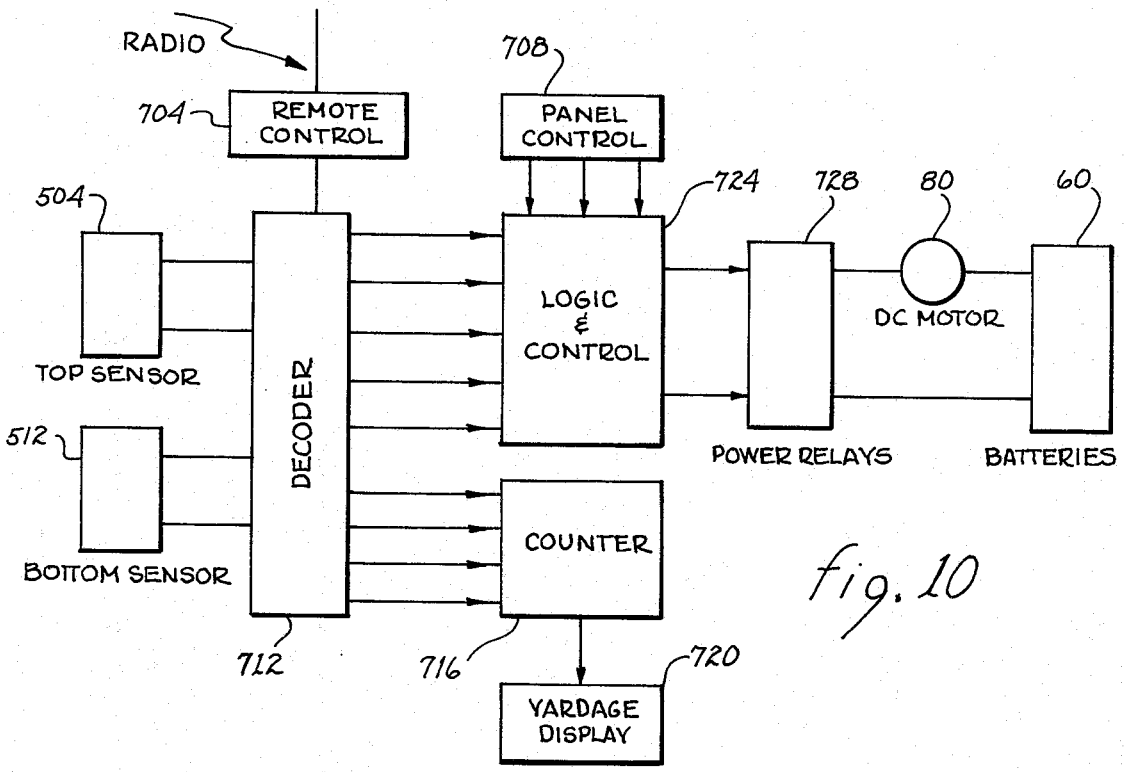
FIG. 10 is a block diagram of the logic control system of the invention.

FIG. 10 is a block diagram of the control functions for the vehicle of the invention. Sensors 504 and 512 receive location and speed change information as the signal emitters (magnets) located at predetermined points on the guide way are passed. Some information may be in a four to 12 digit code which must be decoded by decoder 712 and the output information sent to logic and control 724. Other information will be generated by the operator at the touch panel control 708 which also goes to logic and control 724. A remote radio transmitter can send information via the remote radio control receiver 704 which will start and stop the vehicle.

A yardage count down system is incorporated on the vehicle which has a visual display 720 to instruct the player how many yards are between the vehicle and the next green. The top and bottom sensors 504 and 512 pick up information from signal emitters 500 and 508 in guideway 24 to set the display 720 to 300, 200, 100 or 0 yards depending upon the location of the emitters. As the vehicle progresses toward the green, emitters 500 and 508 in the guideway cause decoder 712 to instruct counter 716 to decrease the count by units of two yards, as displayed on the yardage display 720.

Logic and control unit 724 may consist of hard wired circuits or may incorporate a micro-processor with memory and preprogrammed instructions. The output from this unit or group of integrated units will operate the power relays 728 or power switches which control the flow of current to the motor 80 from batteries 60. The control characteristics will include stop, go, fast, slow, turn, hold slow, conditional stop, automatic control, and reverse (this may be manual for safety reasons), although other controls may be provided if desired. The stop and slow can also be remotely controlled by the radio remote control.

Motivation for the vehicle is not limited to the battery powered D.C. motor described. An A.C. motor, either single or three phase, could be used along with a power distribution system inside the guideway and pick up brushes on the vehicle as described in U.S. Pat. No. 3,838,648. Another system would distribute A.C. voltage which is rectified in a controlled manner on board the vehicle in order to excite a D.C. drive motor. Internal combustion engines burning liquid or pressurized fuels could also power the vehicle. The type of system to be employed to power the vehicle will be dictated at least in part by the type of terrain to be traversed. In cases where steep hills must be traversed, such as at down hill ski areas, internal combustion engines may be required in order to provide the necessary power.

The guideway including reinforcing bars can be constructed in any conventional manner. The design herein illustrated may be slip formed into a continuous one piece strip by available equipment and techniques. A service vehicle may be employed as required for the transportation system herein described. The service vehicle is used to inspect the guideway and rail and may be equipped with sweepers, pumps and the like to clean the guideway and remove water and mud.

A particularly noteworthy feature of this invention is the ability to switch a moving monorail vehicle and in particular to control this switching from within the vehicle. This control can be electronically actuated to switch directions, right, left, or maintain straight ahead movement. The switching of this invention lends itself to automatic as well as manual operation. The complete operation of the vehicle can be made totally automatic.

Control of the vehicle can be accomplished automatically by sensing the true position of the vehicle, the type of switch at a switching junction and the presence of other vehicles in the area. Automatic control will include selection of the route, stop, conditional stop, turn left or right, no turn, speed change, automatic return or call-up of vehicles and vehicle collision avoidance. The system of this invention is inherently safer in operation than the conventional golf cart transportation system as it is confined to the dedicated guideway.

What is claimed is:

1. A steering system for steering a track mounted vehicle through track intersections for branch tracks, the vehicle being directionally guided and laterally supported along each track by vehicle mounted guides bearing against opposed side wall members of the tracks, the improvement comprising in combination;

a. at least one wheel mounted on the vehicle for guiding the vehicle along a path through a track intersection;

b. a laterally pivotable probe extending forwardly of the vehicle for initiating a direction change of the vehicle at an intersection, said probe including means for reorienting said wheel to a direction change of the vehicle at an intersection;

c. a switching means disposed at an intersection of the tracks and responsive to said probe for directing the vehicle through the intersection; said switching means including:

i. a switching vane having a free end;

ii. spring bias means for urging a central location of said switching vane;

iii. pivot means for accommodating lateral pivotal movement of the free end of said switching vane in either rotational direction from the central location to a vehicle guiding location in response to engagement of said switching vane by said probe; and iv. guide means disposed upon said switching vane and cooperating with the vehicle mounted guides for guiding and laterally supporting one side of the vehicle upon engagement of the probe and switching vane and as the vehicle travels through the intersection;

d. control means for pivoting said probe laterally to engage one or another side of said switching vane and, in response to forward movement of the vehicle, forcing said switching vane to pivot laterally to engage said guide means with the vehicle mounted guides;

whereby, during forward motion of the vehicle into an intersection and during engagement with one of the sides of said switching vane, the free end of said switching vane is laterally pivoted to guide and support the vehicle along a selected path through the intersection.

2. The improvement as set forth in claim 1 wherein said switching vane includes a point for engaging said probe.

3. The improvement as set forth in claim 2 wherein said probe includes a pair of sides extending rearwardly and laterally from a point for bearing against said point of said switching vane.

4. The improvement as set forth in claim 3 wherein each of said probe sides are independently pivotable at a location rearward of the point of said probe.

5. The improvement as set forth in claim 2 wherein said probe is triangular in planform with a forwardly directed apex.

6. The improvement as set forth in claim 1 wherein each track and branch track includes:

a. a rail for engaging said wheel and extending to but terminating at each intersection; and b. wall sections disposed within each intersection for limiting the lateral excursion of said wheel within each intersection.

7. The improvement as set forth in claim 6 wherein said wheel includes a rail engaging groove.

8. The improvement as set forth in claim 2 wherein the terminal ends of each said rail are tapered to facilitate disengagement and reengagement of said wheel with each of said rails.

9. The improvement as set forth in claim 1 wherein each of the side wall members in proximity to an intersection includes a recess for accommodating the free end of said switching vane and present a smooth transition for the vehicle mounted guides from the side wall members to said guide means disposed on said switching vane.

* * * * *